United States Patent [19]

Runft

[11] 4,074,112

[45] Feb. 14, 1978

[54] SWITCH ASSEMBLY HAVING MOVABLE CONTACT FACE CONFIGURATION FOR PENETRATING FROST OR ICE LAYER ON ADJACENT CONTACT SURFACE

[75] Inventor: Arthur J. Runft, Mequon, Wis.

[73] Assignee: Kelley Co., Inc., Milwaukee, Wis.

[21] Appl. No.: 629,057

[22] Filed: Nov. 5, 1975

Related U.S. Application Data

[62] Division of Ser. No. 428,923, Dec. 27, 1973, Pat. No. 3,922,814.

[51] Int. Cl.[2] ..... H01H 1/12; H01H 9/00

[52] U.S. Cl. ..... 200/279; 200/52 R; 200/239; 200/244; 200/237

[58] Field of Search ..... 200/242, 244, 253, 52 R, 200/279, DIG. 34, 164 R, 164 A, 61.43

[56] References Cited

U.S. PATENT DOCUMENTS

| | | | |
|---|---|---|---|
| 1,892,008 | 12/1932 | Ross | 200/244 |
| 2,490,020 | 12/1949 | Enzler | 200/242 X |
| 2,788,420 | 4/1957 | Mathews et al. | 200/279 |
| 3,168,165 | 2/1965 | Bagnusco | 200/61.43 X |
| 3,297,851 | 1/1967 | Jaquet | 200/244 X |
| 3,531,799 | 9/1970 | Rendler | 200/253 X |
| 3,842,221 | 10/1974 | Dayet et al. | 200/52 R |
| 3,922,814 | 12/1975 | Runft | 200/279 |

*Primary Examiner*—James R. Scott

*Attorney, Agent, or Firm*—Andrus, Sceales, Starke & Sawall

[57] ABSTRACT

A pneumatic cylinder-piston door operator is connected to an air supply by a solenoid actuated valve. A control circuit selectively energizes the solenoid valve in response to momentary actuation of switches including control and safety switches. For refrigeration unit installation, the switch contacts are formed with one contact having a pimpled surface and the other contact having a serrated surface to provide a reliably electrical connection. For the manual control switches, a microswitch is mounted in a suitable enclosure with appropriate gaskets to minimize the effect of adverse environmental conditions. A spring-loaded plunger is mounted within the housing and provided with an external push-button or pull cord actuator.

4 Claims, 8 Drawing Figures

SWITCH ASSEMBLY HAVING MOVABLE CONTACT FACE CONFIGURATION FOR PENETRATING FROST OR ICE LAYER ON ADJACENT CONTACT SURFACE

This is a division of application Ser. No. 428,923, filed Dec. 27, 1973, now patent no. 3,922,814.

BACKGROUND OF THE INVENTION

This invention relates to fluid operating apparatus for positioning of load devices such as industrial and commercial doors and in particular to a pneumatic operating apparatus having switching means for selectively reversing the driving and holding position of a pneumatic motor means.

Fluid driven positioning apparatus is widely employed in industry for rapidly and reliably positioning of various types of loads, including valves, dampers, machine operating elements as well as various closure members. In the institutional and commercial field, automatic door closures may employ fluid driven operators for automatic closing and opening of the doors in response to an appropriate input signal. Pneumatic driven door operators may employ air supplies which are generally available in other parts of the institution or which can be readily supplied. Pneumatic systems also are highly desirable in connection with the convenient method of exhausting of the system to the atmosphere.

A particularly satisfactory pneumatic door operator providing accurate and versatile controlled movement of the door to permit safe movement of personnel and associated equipment is shown in Applicant's co-pending application, entitled "FLUID ACTIVATED LOAD OPERATOR" and filed herewith. In the preferred embodiment of that application a power cylinder unit includes unique metering valve units connected to each end of the power cylinder for selective connection to an exhaust means and to a pressure source. The metering valve units include a one-way passageway to supply air and a pair of parallel passageways providing for a controlled exhaust to regulate the acceleration and deceleration of the drive. A solenoid control valve selectively establishes the opposite connections to the metering valve units and thereby to the power cylinder unit for selectively opening and closing of the door.

An adaptive interconnecting mechanical linkage includes a drive arm connected to an adjustable excursion arm or link which, in turn, is pivotally interconnected to a second positioning link or arm. A pivotal mounting bracket is adjustably secured to the outer end of the positioning arm for attachment to the door. The mechanical linkage permits the ready adaptation of the single power operator for various type of doors.

The control of the valve or other control means is conveniently automated by an electrical control system which has an electroresponsive means to properly set the control means. The electrical control system is generally provided with suitable electrical switches for actuating of the electroresponsive means in response to suitable manual switch operation. In automatic door operators, safety devices should be incorporated to prevent damage to persons and objects moving through the opening as well as to the door and operator as such. Continued and reliable control operation is particularly required in industrial and commercial applications where relatively heavy doors are encountered in varying environmental conditions. Thus, the motor means and switch means should respond to rapidly and reliably reverse the door movement, particularly during the door closing when personnel and/or equipment may be within the door opening.

SUMMARY OF PRESENT INVENTION

The present invention is particularly directed to a powered operator having means to create relative large closing forces and having control switch means including force responsive safety switch means to respond to abnormal force levels to automatically actuate the operator. Although the present invention can be employed in any desired control, the invention is particularly adapted to the door operator shown in Applicant's co-pending application.

In accordance with the present invention, a force sensitive switch means is coupled to the door mechanism and responds to the level of the opposing force directly within the mechanism to detect abnormal conditions and effect a reversal of the door movement. The sensitive switch means thus responds to the opposing force which acts against abnormal positive driving force and inertial force within the moving door mechanism.

In accordance with a particularly novel feature of the present invention, a switch means is located in the path of a force transmitting element forming a part of a connecting linkage and responds to deflection thereof as a result of the driving and/or inertial forces.

The mechanical linkage in a preferred construction includes a drive arm which is pivotally interconnected to a mounting bracket and to the piston rod of a prime mover. A flexible, adjustably extendible member is releasably interconnected to the drive arm as an extended cantilever laterally spaced from the drive arm. The flexible member extends outwardly and is interconnected at the outer end to a coupling linkage for connection to the door proper.

A reversing or other interconnecting control switch is coupled to the drive arm with an actuator in spaced relation to the outer surface of the flexible member. The actuator is located in the plane of movement for the pivoting arm and flexible member. The flexible member has sufficient rigidity to transmit door operating forces to the door structure with minimum flexure for opening and closing of the door. In the event of any abnormal opposing forces, however, the drive forces increase rapidly in an attempt to overcome such opposing force and the cantilevered member flexes with respect to the drive arm. At a selective abnormal force level, the member will deflect sufficiently to actuate the switch.

In a particularly simple and novel structure, the drive arm is a simple tube member. A flexible excursion rod is telescoped into a plug in the drive tube and suitably, releasably secured therein. The drive arm tube has a pair of oppositely spaced threaded openings lying in the plane of movement through the center of the tube. The switch includes a threaded mounting element mounted in the threaded opening with a suitable lock nut to permit selective adjustment of the position of the switch actuator with respect to the flexible rod. Thus, any opposing force on the door or linkage results in an increased deflection in the common plane to activate the switch as a selected force level.

If the safety response is desired only in response to one movement, for example, during the closing when the greatest danger of damage to person and property exists, a single safety switch is employed. To provide protection in both directions of movement, a pair of switches is mounted to the opposite sides of the flexible rod.

Further, in addition to automatic switch controls which may conveniently be of a pull-cord type switch or the like which must operate reliably in different environmental conditions. For example, in a commercial refrigeration installation, special care must be established to maintain reliable switch operation. The switches are generally low voltage switches and the contacts must be maintained in a reliable condition to maintain proper power supply to the ratcheting relay or the like. Applicant has found that the use of conventional micro-switches normally provides sufficient response and control. However, in certain atmospheres, such as frost-like conditions encountered in refrigeration units and the like, Applicant has further found that the contacts should be especially constructed to maintain highly desired operation. In particular, Applicant has found that a pair of opposing contacts, one of which is provided with a pimple surface and the other of which is provided with a serrated surface, provides an unusually satisfactory response. The switch can be mounted adjacent the door with the push-button operator, on the ceiling with a pull-cord operator or the like. Thus, typically in a warehouse installation a celing mounted control switch is provided permitting control by a forklift operator and the like, with a control cord which is readily accessible to the forklift operator as he approaches the door. A slight momentary pull on the rope handle actuates a small microswitch to appropriately control the operator to open and close the door as required.

In accordance with a particular feature, the microswitch is mounted in a suitable enclosure with appropriate gaskets to minimize the effect of adverse environmental conditions. A spring-loaded plunger is mounted within the housing and provided with an external actuator for momentarily actuating the switch. The plunger is coupled to a pull-cord operator or to a pushbutton operator and includes a stop which limits the travels of the actuator and prevents overtravel of the switch to maintain a long switch life.

A simple and reliable electrical control for the solenoid valve or the like employs a bistable switch means such as ratcheting relay means having contacts alternately set between a closed door position and an open door position. Thus, it is only necessary to pulse the ratcheting relay means to selectively energize the solenoid valve and thereby control the operating air connection. The various control and safety switches may be parallel connected to control the ratcheting relay during the appropriate opening and closing of the door.

The safety and control switch means of this invention provide a reliable, power door operator for safe, reliable operation in commercial and institutional type installation with full protection of personnel and equipment.

BRIEF DESCRIPTION OF THE DRAWINGS

The drawings furnished herewith illustrate preferred constructions of the present invention in which the above advantages and features are clearly disclosed as well as others which will be readily understood from the subsequent description of such embodiments.

In the drawing.

DESCRIPTION OF THE ILLUSTRATED EMBODIMENTS

Figure 1:
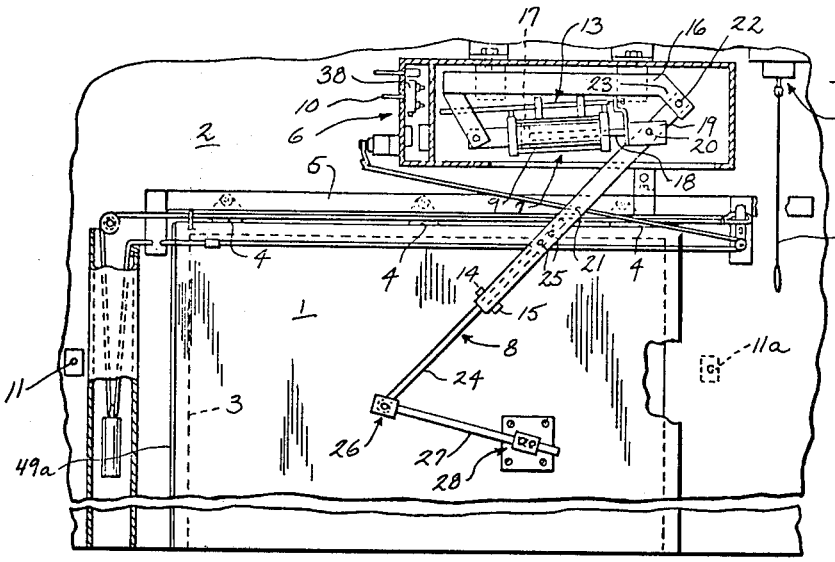
FIG. 1 is a front elevational fragmentary view of a door operator applied to a horizontal sliding door unit forming a part of a building structure.

Referring to the drawing and particularly to FIG. 1, the present invention is shown applied to a sliding door 1 forming a part of a building structure 2 and overlying an access opening 3. The sliding door 1, in accordance with conventional practice, is hung by a pair of spaced trolley units 4 from a suitable track structure 5. An automatic power door opener or operator 6 preferably constructed, in accordance with the teaching of Applicant's co-pending application entitled FLUID ACTIVATED LOAD OPERATOR and filed on the same day as this application, is shown mounted above the door track 5. Generally, the power operator illustrated in FIG. 1 includes a power pneumatic cylinder unit 7 coupled to the door through an adjustable driving linkage unit 8 which may be adapted to various sizes and types of doors. The pneumatic operator 6 may be driven from any suitable pneumatic supply such as the usual air supply employed in commercial establishments. The pneumatic cylinder 9 of unit 7 is coupled to a suitable air supply line 10 in response to any one of a plurality of control switch units. Switch units 11 and 11*a* shown as a pushbutton type may be wall mounted on the opposite walls adjacent to the door structure 1. Additionally, a pull-cord type switch unit 12 may also be provided to opposite sides. Switch unit 12 may be conveniently actuated by a forklift operator or the like as he approaches the door 1 to permit opening and closing of the door without leaving the vehicle.

A unique travel damping value unit 13 is mounted as a part of the power cylinder operator 6 to control the acceleration and deceleration of the door movement during both the opening and closing. Generally, each actuation of any of the switch units 11 – 12 actuates the operator 6 from the previous actuation to reverse the door movement and thereby provide for the alternate opening and closing. Further, the door movement can be reversed during any portion of the door movement and is provided with an automatic and unique reversing safety switch means to prevent damaging to protect personnel and equipment in accordance with the teaching of this invention. In the illustrated embodiment of the invention, a pair of safety switches 14 and 15 are connected to the linkage unit 8 and respond to abnormal forces on the door 1 and linkage unit 8 to reverse the door movement, as more fully developed hereinafter.

More particularly, the power cylinder 9 is pivotally mounted at one end to a supporting frame member 16. The usual piston 17 in the cylinder 9 is connected to a piston rod 18 and projecting outwardly from the front of the cylinder and coupled by a bracket 19 and pin 20 to a drive arm 21 of the door connecting linkage unit 8. The upper end of the arm 21 is connected by a pivot attachment 22 to a small depending bracket 23 from the top leg of the mounting frame 16. The power cylinder unit 9 is thus mounted to permit limited pivotal movement as the piston and rod 18 and interconnecting linkage unit 8 are moved to open and close the door 1.

The adjustable driving linkage unit 8 in the embodiment of the invention includes the arm 21 and a cantilevered excursion arm or rod 24 which extends outwardly therefrom. Arm 21 in the illustrated embodiment of the invention is a suitable tubular member. A pair of set screws 25 thread through arm 21 and secure rod 24 with the outermost end connected by a pivot unit 26 to a positioning rod 27. The positioning rod 27 projects outwardly and is adjustably secured to a pivotal mounting unit 28 which is bolted or otherwise firmly affixed to the door 1.

The multiple adjustable linkage unit 8, as more fully disclosed in the Applicant's co-pending application, adapts the operator to different horizontal and vertical sliding doors, swinging doors and overhead doors.

Figure 2:
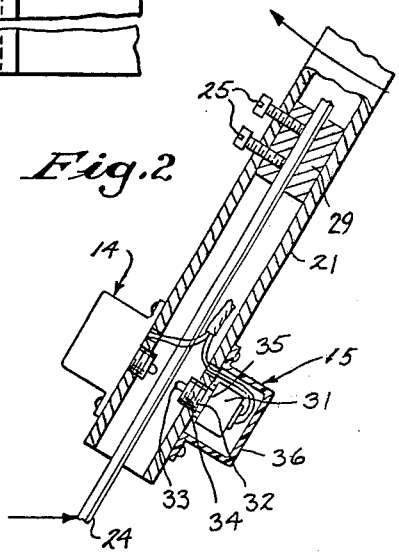
FIG. 2 is an enlarged fragmentary view of the power door operator system shown in FIG. 1 with parts broken away and sectioned to more clearly illustrate the detail of construction.

As most clearly shown in FIG. 2, excursion rod 24 projects into the drive arm tube 21. The rod 24 has a significantly smaller diameter than tube 21 and is connected to an attachment plug 29 which is firmly affixed within the drive arm tube 21. The excursion rod 24, as secured within plug 29, is in spaced relation to tube 21. Rod 24 is formed of a suitable flexible steel which is selected to provide minimal deflection under normal opening and closing loads. In the event of an abnormal load on the door 1 and/or linkage unit 8 such as an obstruction to the door movement, rod 24 deflects significantly to actuate one of the reversing safety switches 14 or 15 depending upon the direction of movment.

Each of the switch units 14 and 15 is similarly constructed and unit 14 is shown and described in detail.

The switch unit 14 includes a basic normally open switch 31 with a threaded tubular mounting hub 32. A pushbutton actuator 33 projects outwardly of the mounting hub 32. The switch hub 32 is threaded into an appropriately threaded opening 34 in the arm 21 to locate the actuator 33 in predetermined, spaced relation to the flexible undeflected rod 24. A lock-nut 35 on the threaded hub 32 permits locking of the switch unit 31 to the arm 21 to maintain the desired switch position. The actuator 33 is located in the plane of movement of the linkage unit 8 and thus in the plane of deflection of rod 24 in the event a holding or opposing force is applied which limits or prevents the movement of the door in the closing direction in the illustrated embodiment.

The switch unit 31 is desirably protected by an outer housing 36 shown as a cup-shaped member overlying the switch and having securement tabs releasably attached to arm 21 by suitable attachment screws. Switch 15 is similarly constructed and mounted in the diametrically opposite side of arm 21 to respond during the opening of door 1.

Figure 3:
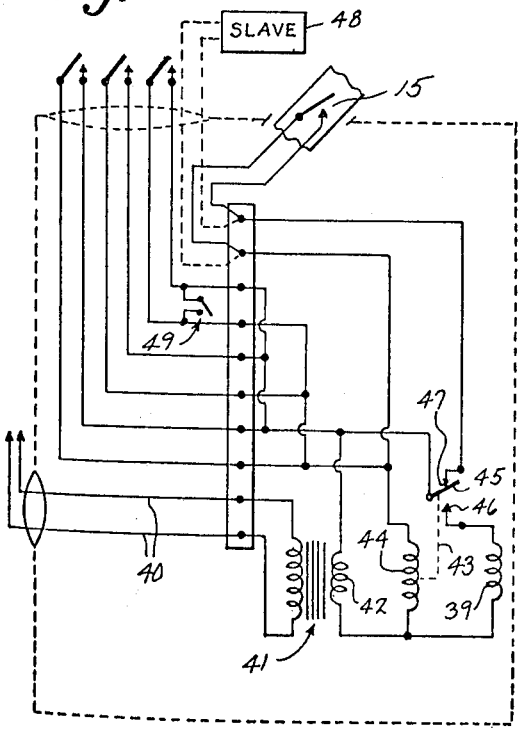
FIG. 3 is a schematic illustration of a control circuit for application to the operator of FIGS. 1 and 2.

The reversing safety switch units 14 and 15 are connected into the control circuit for the door operator 5, such as shown in FIG. 3, to automatically reverse the door movement in the event of an abnormal restraining force. The flexible rod 24 will, under all normal conditions, directly transfer the opening and closing forces to the door 1 without flexure. In the presence of any predetermined abnormal restraining loads on the door movement, however, the rod 24 will continuously, increasingly flex with the free load and activate the appropriate safety switch 14 or 15 at a selected force.

The amount the arm 24 deflects is directly proportional to the opposing force and produces a very rapid response to a large holding force such as an obstruction within the door opening 3. Further, in combination with the pneumatic operator 6, the response is sufficiently rapid to essentially eliminate the danger of significant damage to person or property engaged by the moving door 1. Thus, a continuous force coupling is maintained between the operator 6 and the door 1 such that upon signalling of a reversal, the door reverses movement almost instantaneously. Thus, in many installations, the response of the safety switch means 14 or 15 avoids the necessity of the well-known door-edge switch means.

The power cylinder unit 7 is shown controlled by a four-way solenoid valve unit 38 of any suitable construction such as a spring-loaded unit disclosed in the co-pending application. In the illustrated operator position, valve 38 is set such that inlet pressure is applied to the front head of the cylinder 9 while the rear head is connected to the related exhaust. Conversely, when the solenoid valve unit 38 is energized the connection is reversed to exhaust through the front head and supply air through the rear head to reverse the movement of the piston rod 18 and door 1. A particularly satisfactory system and circuit for operating of the solenoid valve unit 38 in accordance with the present invention is illustrated in FIG. 3 wherein the winding or coil 39 for solenoid air valve unit 38 is selectively connected to a suitable power source such as the usual alternating current power supply. The solenoid valve unit and circuit is preferably a low voltage system and is coupled to the incoming conventional supply line 40 through a step-down transformer 41, which provides the desired low voltage output. One end of winding 39 is connected to the common of the transformer secondary 42 and the opposite end is selectively connected by a relay unit 43 to the opposite side of the secondary 42. Relay unit 43 is energized in response to momentary actuation of any one of the illustrated control or safety switches 11, 11*a*, 12, 14 and 15, as follows.

The relay unit 43 is preferably of a ratcheting type having a drive winding 44 connected to the secondary 42 in series parallel with the several control switches 11 - 11*a*, 12, 14 and 15. The closure of any one or more of switches 10 - 12 energize the relay winding 44 which drives a suitable ratchet mechanism to transfer and latch the relay contacts between alternate door open and door close position. The switches 11, 11*a*, 12 as well as the safety switches 14 and 15, preferably are constructed to provide a direct momentary operation to prevent the accidental continued energization of the ratcheting relay. Thus, the ratcheting relay normally requires deenergization and energization before it will actually step its contacts.

The contacts of the ratcheting relay 43 are shown including a common movable pole or arm 45 connected to the secondary 42 of the transformer 41 and selectively engaged with a door open contact 46 and a door close contact 47. The door open contact 46 is connected to the air valve coil 39 which is energized to effect the opening, and holding of the door open. The close door contact 47 deenergizes coil 39 to effect closing of the door and holding of the door closed.

The close door contact 47 is provided to establish an interlock to the safety reversing switch 15. In the illustrated embodiment, contact 47 is connected in series with safety switch 15 to energize the relay 43 during the door closure cycle if an abnormal condition results in closing of switch 15.

Thus, in summary, assuming the door is in the closed position illustrated, personnel actuating either of the pushbutton, pull-cord switches 11 or 11*a*, and 12 actuates the ratcheting relay 43.

The switch contact arm 45 moves from the illustrated closed door position to energize the solenoid coil 39 until the relay 43 is again actuated to reset the contacts.

The solenoid valve unit 38 is energized and connects the rear cylinder head to the air supply lines 10 and connects the front head port to exhaust, the extending piston thereby opening the door with a cushioned stopped movement. The power cylinder unit 7 positively holds the door in the open position until such time as personnel actuates a control switch 11, 11*a* or 12 to close the door 1. The latter would reset the ratcheting relay contacts to the full line position shown, deenergizing the solenoid coil 39. The spring-loaded solenoid valve unit 38 would then automatically return to the reset position, reverse the connection between the cylinder and air supply, with the resulting powered damped closing of the door.

The safety switches 14 and 15 are normally open. The switch 15 is wired between the power supply and the top side of the ratcheting relay coil 44 in series with the fixed close door contact 47 of the ratchet relay 43. Thus, if the door in moving to the closing position encounters an obstruction the safety switch 15 is rapidly activated by the flexible rod or arm 24, again ratchets the relay 43 to practically instantaneously reverse the position of the solenoid unit 38. The power actuator 6 is oppositely connected to the air supply to reverse the drive and again provide door opening movement.

If both safety switches 14 and 15 are provided, the switches may be parallel connected within arm 21 and common leads 47*a* connected to any one of the normal control switch terminals, such as the terminals for switches 11, 11*a* and 12, or to their respective fixed contacts of the ratcheting relay 43.

Thus, although shown applied to a sliding door, the dual safety switch construction is more generally employed in connection with swinging door. The sliding door in moving to the open position does not encounter any damaging interference except perhaps in the most unusual circumstances.

Where the power operator forms part of a biparting door unit, a pair of operators 6 will be provided, one for each door element. One of the door operators is provided with the necessary electrical control and solenoid air valve unit and functions as a master. The second unit includes the power cylinder and separate travel damping valves and is connected through suitable connecting fluid lines with the master operator and functions as the slave unit. The safety switch means 48 of the slave unit is parallel connected with the safety switch of the main operator as shown in FIG. 3.

The door 1 may also be provided with additional safety features such as a safety edge switch 49 such as commonly employed in elevator doors and other structures. The switch 49 may be actuated from a small pneumatic tube 49*a* by an electrical safety edge switching element or any other suitable sensor on the edge of the door 1. The switch 49 is shown parallel connected in the same manner as switches 11 – 12 and if necessary may be connected to the same terminals, and particularly in parallel with switch 15 to respond only during closing. In the latter, once actuated, the door 1 reverses and completely opens even though the engaging person or article again actuates switch 49.

The present invention provides a reliable and relatively simple control for a power door operator which particularly provides the desired response to possible damaging interference with the door movement.

Further, the present invention may be operated in low temperature environments in which frost may form on the several components including the contacts of the control switches. In particular in commercial freezer rooms and the like, the control switches may be located within the cold room. Although the operator may be conditioned as disclosed in Applicant's copending application, the satisfactory operation is dependent on reliable switch operation. This is particularly significant, for example, in connection with opening of the door to accommodate powered vehicles where the operator may actuate the pull-cord switch unit and move toward the door assuming it will properly open.

Figure 4:
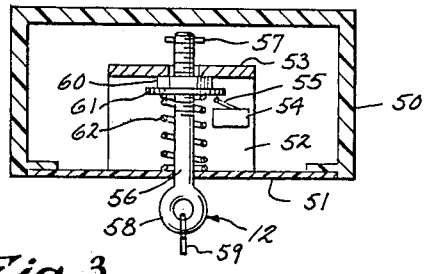
FIG. 4 is an enlarged sectional view of a pull-cord switch unit shown in FIG. 1.
Figure 5:
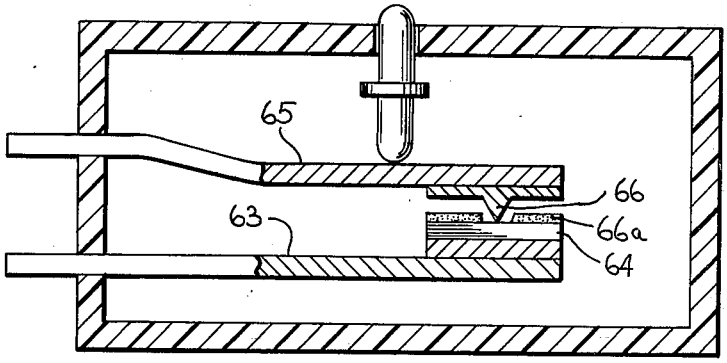
FIGS. 5 and 6 are sectional views of switch contacts employed in the control switches particularly for selected low temperature installations.
Figure 6:
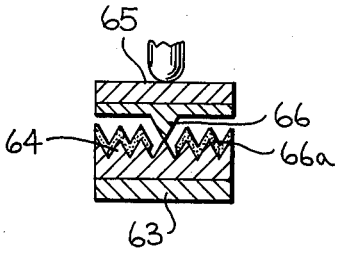
Figure 8:
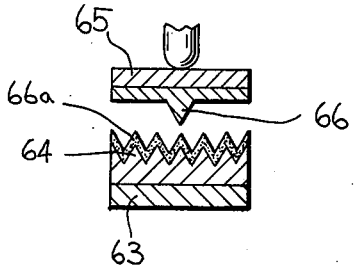
FIG. 8 is a view similar to FIG. 6 similarly illustrating the contacts open. de
Figure 7:
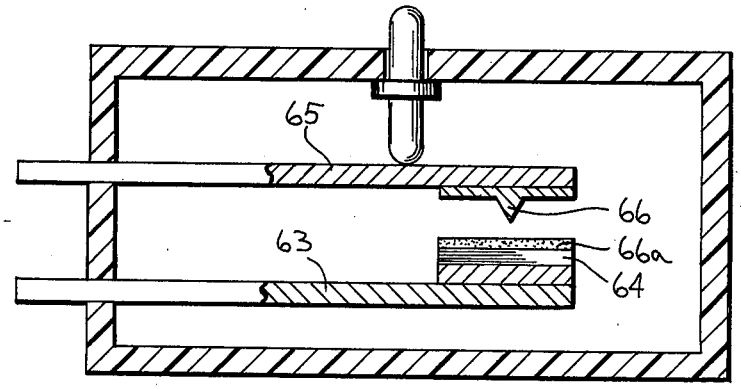
FIG. 7 is a view similar to FIG. 5 illustrating the switch with the contacts open.

Applicant has found that for low temperature environments the switch and particularly the switch contacts are advantageously formed in accordance with the illustration of the pull-cord switch unit shown in FIGS. 4 – 6.

The illustrated switch 12 includes a suitable housing 50 having a removable gasketed front cover 51. The housing 50 is provided with suitable mounting openings in accordance with usual practice. A switch bracket 52 is secured to the cover 51 and includes an inner wall or flange 53. The control switch 54 is mounted to the bracket 52 beneath flange 53, with a small pivoted actuator 55. An operating plunger 56 shown as an eye bolt is slidably mounted through the cover 51 and flange 53 with an interlock nut 57 on the innermost bolt end. The eye 58 of the bolt 56 is located to the cover side and provides a connection to the pull-cord 59. An actuating nut 60 is secured to the bolt and includes an annular flange 61 which moves in the path of the actuator 55. A coil spring 62 encircles the bolt 56 between the cover 51 and the nut 60 to spring load the plunger to the standby position with flange 61 spaced from the switch. Thus, a forklift operator need only pull on the cord 59 to move the flange past the actuator 55 and thereby momentarily close the switch 54.

The wall-mounted units 11 and 11*a* may be generally similarly constructed with the switch as such oppositely disposed and the actuating nut located to the opposite side of the switch such that the inward movement of the plunger actuates the switch.

The switches employed are suitable low voltage microswitches which, particularly for low temperature applications, are specially constructed to eliminate malfunctioning as a result of frost and similar surface contact conditions. The switch 54 is typically a single-pole, single-throw, normally-open momentary switch rated for 4 amps at 24 (or more) volts of 60 hertz alternating supply.

As shown in FIG. 5, one contact 63 is provided with a serrated face defining a plurality of parallel ridges 64. The opposing contact 65 is formed with a pimpled surface defining a penetrating point 66 penetrating the frost 66*a*. In FIG. 5, the point 66 is shown relatively enlarged for purposes of illustration. Thus, in a small microswitch having a contact of approximately ⅛ inch, the pimple was a small pin-point projection located centrally of the contact. Applicant has found that the illustrated construction provides reliable response of the control switch 54 in the usual commercial refrigeration installation and particularly adapts an electrically controlled power door operator to practical use therein.

Although illustrated and described as normally open switches, the control may employ normally closed switches. The reversing switches may then be mounted to be held open by engagement with the unstressed or flexed rod and released by flexing thereof. The switch units would then, of course, be reversely mounted to the illustrated arm. Further, the circuit may, of course, be responsive to the opening of a switch rather than the closing. The switch units are then selected and mounted to provide the necessary response. Although the illustrated force responsive switches and actuating means have been found particularly satisfactory, within the broad aspects of this invention, they may be incorporated in any other portion of the linkage coupling between the door and power cylinder. Further other force related means might be employed such as inertial type switches and pressure sensor forming a part of piston-cylinder mechanism or the supporting framework for the pivotal-mounted cylinder unit.

The integration of the safety switch means into mechanism which maintains a continuous driving force on the door provides the desired rapid reversing response while permitting continued operation in the event of a transient interference of very short and non-damaging character. The switch means and coupling are of a relatively simple, reliable, rugged construction which can be factory assembled in accordance with various installation requirements.

The present invention thus provides a highly improved control system for pneumatic positioning device and particularly one adapted to the opening and closing of heavy industrial type doors and the like.

Various modes of carrying out the invention are contemplated as being within the scope of the following claims particularly pointing out and distinctly claiming the subject matter which is regarded as the invention.

I claim:

1. An automatic door operator having a control circuit connected to an electrically controlled motor means for controlling door movement in a freezing environment wherein frost forms on the surfaces within the environment, comprising a control switch adapted to be connected in said control circuit and having a pair of opposed electrical contacts, said contacts having opposed contact faces and said contacts solely moving on a line essentially perpendicular to said contact faces for opening and closing an electrical conductive path therebetween in response to the movement directly toward and away from each other on the line through said contacts, a first of said contacts having the contact face formed with a pimple and the other of said contacts having the contact face with a plurality of serrations defining a series of sharp contact peaks, said pimple defining a penetrating means to disrupt frost on said serrations of the other of said contacts and permit said pimple to move into conductive engagement with said second contact.

2. The automatic door operator of claim 1 wherein said pimple is a sharp pin-like projection centrally located on the contact and substantially spaced from the outer periphery of the contact.

3. The automatic door operator of claim 1 wherein said pimple is a sharp pin-like member terminating in a sharp point adjacent said serrations, said serrations including a plurality of parallel, generally triangular shaped serrations defining upper or outer ridge line surfaces.

4. The automatic door operator of claim 1 wherein said switch includes a rating on the order of 4 amps, at 24 volts of 60 Hertz alternating power.

* * * * *